US007076891B2

(12) United States Patent
Goodwin

(10) Patent No.: US 7,076,891 B2
(45) Date of Patent: Jul. 18, 2006

(54) FLEXIBLE FLUID-FILLED BLADDER FOR AN ARTICLE OF FOOTWEAR

(75) Inventor: David A. Goodwin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 194 days.

(21) Appl. No.: 10/704,566

(22) Filed: Nov. 12, 2003

(65) Prior Publication Data

US 2005/0097777 A1 May 12, 2005

(51) Int. Cl.
*A43B 13/20* (2006.01)

(52) U.S. Cl. ..... 36/29; 36/35 B; 36/28

(58) Field of Classification Search ..... 36/29, 36/28, 69, 71, 76, 68
See application file for complete search history.

(56) References Cited

U.S. PATENT DOCUMENTS

| | | | | |
|---|---|---|---|---|
| 3,683,431 | A | | 8/1972 | Pannal et al. |
| 4,183,156 | A | | 1/1980 | Rudy |
| 4,219,945 | A | | 9/1980 | Rudy |
| 4,287,250 | A | | 9/1981 | Rudy |
| 4,906,502 | A | | 3/1990 | Rudy |
| 4,936,029 | A | | 6/1990 | Rudy et al. |
| 5,083,361 | A | | 1/1992 | Rudy |
| 5,572,804 | A | | 11/1996 | Skaja et al. |
| D396,342 | S | * | 7/1998 | Foxen et al. ..... D2/961 |
| 5,976,451 | A | | 11/1999 | Skaja et al. |
| 5,987,781 | A | * | 11/1999 | Pavesi et al. ..... 36/29 |
| 5,993,585 | A | | 11/1999 | Goodwin et al. |
| 6,029,962 | A | | 2/2000 | Shorten et al. |
| 6,098,313 | A | | 8/2000 | Skaja |
| 6,119,371 | A | | 9/2000 | Goodwin et al. |
| 6,205,682 | B1 | | 3/2001 | Park |

OTHER PUBLICATIONS

International Search Report in corresponding PCT application, application No. PCT/US2004/037044 mailed Feb. 11, 2005 (9 pages).

* cited by examiner

*Primary Examiner*—Jila M. Mohandesi
(74) *Attorney, Agent, or Firm*—Banner & Witcoff, Ltd.

(57) ABSTRACT

A fluid-filled bladder for an article of footwear is disclosed that includes a sealed outer barrier and a tensile member. The barrier is substantially impermeable to a fluid contained by the bladder, and the tensile member is located within the barrier and bonded to opposite sides of the barrier. The tensile member defines a flexion area that promotes flexing of a first portion of the bladder with respect to a second portion of the bladder. The flexion area is an area where the tensile member is absent, and the flexion area may have the configuration of a space, aperture, or indentation, for example.

46 Claims, 7 Drawing Sheets

FLEXIBLE FLUID-FILLED BLADDER FOR AN ARTICLE OF FOOTWEAR

BACKGROUND OF THE INVENTION

1. Field of the Invention

The present invention relates to a fluid-filled bladder suitable for footwear applications. The invention concerns, more particularly, a fluid-filled bladder having a tensile member with flexion areas that enhance the overall flexibility of the bladder.

2. Description of Background Art

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control foot motion, such as over pronation. Accordingly, the upper and the sole structure operate cooperatively to provide a comfortable structure that is suited for a wide variety of ambulatory activities, such as walking and running. The general features and configuration of the sole structure are discussed in greater detail below.

The sole structure of athletic footwear generally exhibits a layered structure that includes a comfort-enhancing insole, a resilient midsole formed from a polymer foam, and a ground-contacting outsole that provides both abrasion-resistance and traction. Suitable polymer foam materials for the midsole include ethylvinylacetate or polyurethane that compress resiliently under an applied load to attenuate ground reaction forces and absorb energy. Conventional foam materials are resiliently compressible, in part, due to the inclusion of a plurality of open or closed cells that define an inner volume substantially displaced by gas. That is, the foam includes bubbles formed in the material that enclose the gas. Following repeated compressions, however, the cell structure may deteriorate, thereby resulting in decreased compressibility of the foam. Thus, the force attenuation and energy absorption characteristics of the midsole may decrease over the lifespan of the footwear.

One way to overcome the drawbacks of utilizing conventional foam materials is disclosed in U.S. Pat. No. 4,183,156 to Rudy, hereby incorporated by reference, in which cushioning is provided by inflatable inserts formed of elastomeric materials. The inserts include a plurality of tubular chambers that extend substantially longitudinally throughout the length of the footwear. The chambers are in fluid communication with each other and jointly extend across the width of the footwear. U.S. Pat. No. 4,219,945 to Rudy, hereby incorporated by reference, discloses an inflated insert encapsulated in a foam material. The combination of the insert and the encapsulating material functions as a midsole. An upper is attached to the upper surface of the encapsulating material and an outsole or tread member is affixed to the lower surface.

Such bladders are generally formed of an elastomeric material and are structured to have an upper or lower surface that encloses one or more chambers therebetween. The chambers are pressurized above ambient pressure by inserting a nozzle or needle connected to a fluid pressure source into a fill inlet formed in the bladder. After the chambers are pressurized, the fill inlet is sealed, for example, by welding, and the nozzle is removed.

Bladders of this type have been manufactured by a two-film technique, in which two separate sheets of elastomeric film are formed to exhibit the overall peripheral shape of the bladder. The sheets are then welded together along their respective peripheries to form a sealed structure, and the sheets are also welded together at predetermined interior areas to give the bladder a desired configuration. That is, the interior welds provide the bladder with chambers having a predetermined shape and size at desired locations. Such bladders have also been manufactured by a blow-molding technique, wherein a liquefied elastomeric material is placed in a mold having the desired overall shape and configuration of the bladder. The mold has an opening at one location through which pressurized air is provided. The pressurized air forces the liquefied elastomeric material against the inner surfaces of the mold and causes the material to harden in the mold, thereby forming a bladder with the desired shape and configuration.

Another type of prior art bladder suitable for footwear applications is disclosed in U.S. Pat. Nos. 4,906,502 and 5,083,361, both to Rudy, and both hereby incorporated by reference. This type of bladder is formed as a fluid pressurized and inflated structure that comprises a hermetically sealed outer barrier layer which is securely fused substantially over the entire outer surfaces of a tensile member having the configuration of a double-walled fabric core. The tensile member is comprised of first and second outer fabric layers that are normally spaced apart from one another at a predetermined distance. Connecting or drop yarns, potentially in the form of multi-filament yarns having many individual fibers, extend internally between the proximal or facing surfaces of the respective fabric layers. The filaments of the drop yarns form tensile restraining means and are anchored to the respective fabric layers. A suitable method of manufacturing the double walled fabric structure is double needle bar Raschel knitting.

U.S. Pat. Nos. 5,993,585 and 6,119,371, both issued to Goodwin et al., and both hereby incorporated by reference, disclose a bladder utilizing a tensile member, but without a peripheral seam located midway between the upper and lower surfaces of the bladder. Instead, the seam is located adjacent to the upper surface of the bladder. Advantages in this design include removal of the seam from the area of maximum sidewall flexing and increased visibility of the interior of the bladder, including the connecting yarns. The process utilized to form a bladder of this type involves the formation of a shell, which includes a lower surface and a sidewall, with a mold. A tensile member is placed on top of a covering sheet, and the shell, following removal from the mold, is placed over the covering sheet and tensile member. The assembled shell, covering sheet, and tensile member are then moved to a lamination station where radio frequency energy fuses opposite sides of the tensile member to the shell and covering sheet and fuses a periphery of the shell to the covering sheet. The bladder is then pressurized by inserting a fluid so as to place the connecting yarns in tension.

While the cushioning benefits of bladders in articles of footwear are well documented, the prior art bladders with a tensile member having the configuration of a double-walled fabric core are generally considered to be relatively inflexible. The present invention relates, therefore, to a more flexible fluid-filled bladder with a tensile member.

SUMMARY OF THE INVENTION

The present invention is a fluid-filled bladder for an article of footwear that includes a sealed outer barrier and a tensile member. The barrier is substantially impermeable to a fluid contained by the bladder, and the tensile member is located within the barrier and bonded to opposite sides of the barrier. The tensile member defines a flexion area that promotes flexing of a first portion of the bladder with respect to a second portion of the bladder.

The flexion area may be a space between two separate sections of the tensile member, with each of the two separate sections being located in one of the first portion or the second portion of the bladder. The space may be oriented diagonally with respect to a longitudinal axis of the bladder, or oriented perpendicular to the longitudinal axis of the bladder. Furthermore, a width of the space may be constant between the two separate sections of the tensile member, or the width of the space may vary between the two separate sections of the tensile member. In some embodiments, the flexion area may be a plurality of spaces between separate sections of the tensile member. Alternately, the flexion area may be at least one aperture extending through the tensile member, or the flexion area may be at least one indentation extending inward from an edge of the tensile member.

In another aspect of the invention the bladder includes a sealed outer barrier and a tensile member. The barrier forms a first surface, an opposite second surface, and a sidewall extending between the first surface and the second surface. The outer barrier is substantially impermeable to a fluid contained by the bladder. The tensile member is enclosed within the barrier and bonded to each of the first surface and the second surface. The tensile member is also present in a first area of the bladder and absent in a second area of the bladder, the second area of the bladder being spaced inward from the sidewall. At least one of the first surface and the second surface are substantially planar in the first area, and the at least one of the first surface and the second surface project outward in the second area.

Yet another aspect of the invention involves a method of manufacturing the bladder. The method includes a step of defining at least one flexion area in the tensile member, with portions of the tensile member being absent in the flexion area. The tensile member is then placed between two polymer sheets, and the wall structures are bonded to the polymer sheets. A peripheral bond is then formed between the polymer sheets and around the tensile member to substantially seal the tensile member within the bladder.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of athletic footwear incorporating a fluid-filled bladder in accordance with the present invention. Concepts related to the footwear, and more particularly the fluid-filled bladder, are disclosed with reference to footwear having a configuration that is suitable for running. The invention is not solely limited to footwear designed for running, however, and may be applied to a wide range of athletic footwear styles, including basketball shoes, cross-training shoes, walking shoes, tennis shoes, soccer shoes, and hiking boots, for example. In addition, the invention may also be applied to footwear styles that are generally considered to be non-athletic, including dress shoes, loafers, sandals, and work boots. Accordingly, one skilled in the relevant art will appreciate that the concepts disclosed herein apply to a wide variety of footwear styles, in addition to the specific style discussed in the following material and depicted in the accompanying figures.

Figure 1:
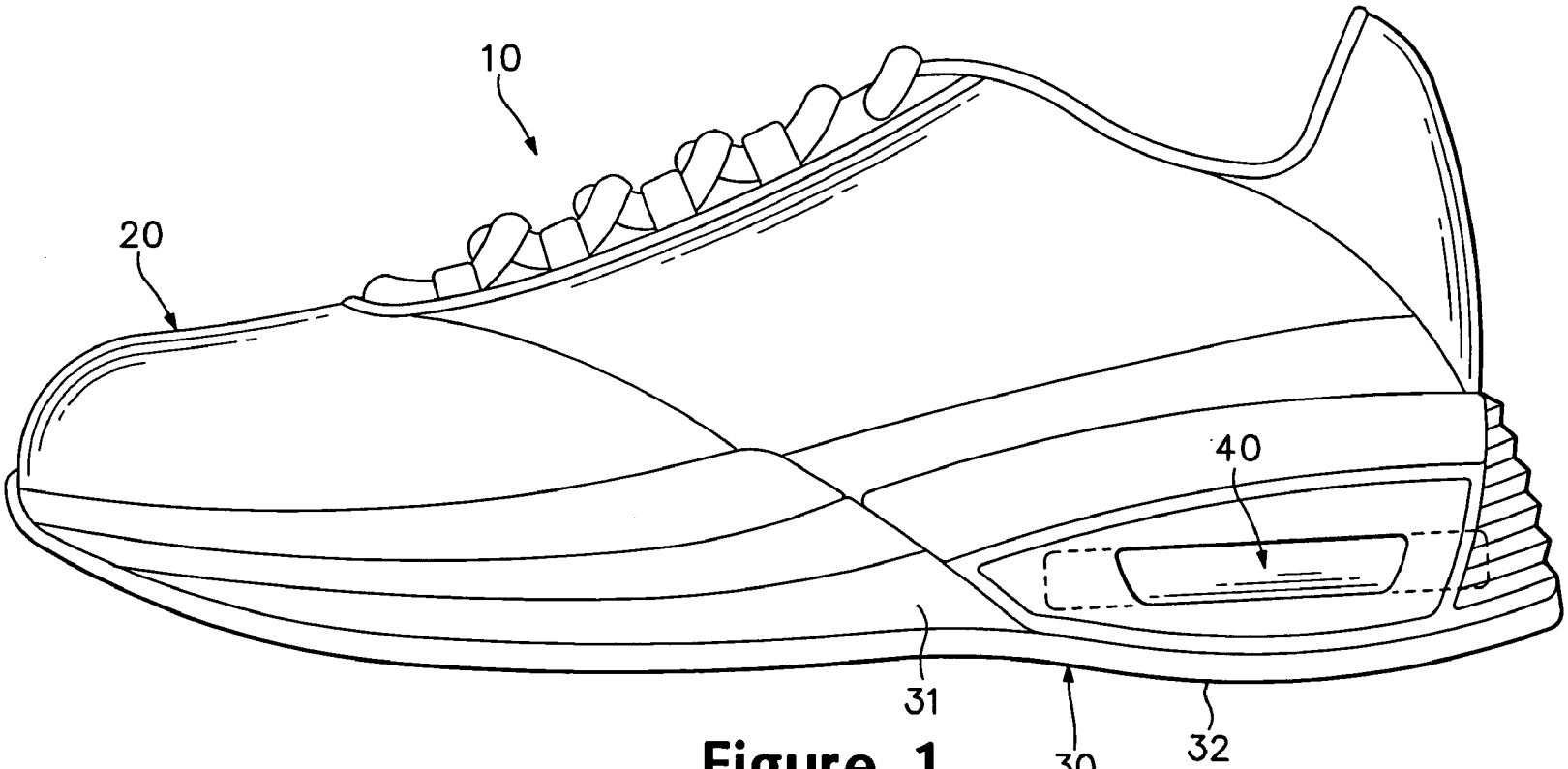
FIG. 1 is a lateral elevational view of an article of footwear incorporating a first bladder in accordance with the present invention.
Figure 2:
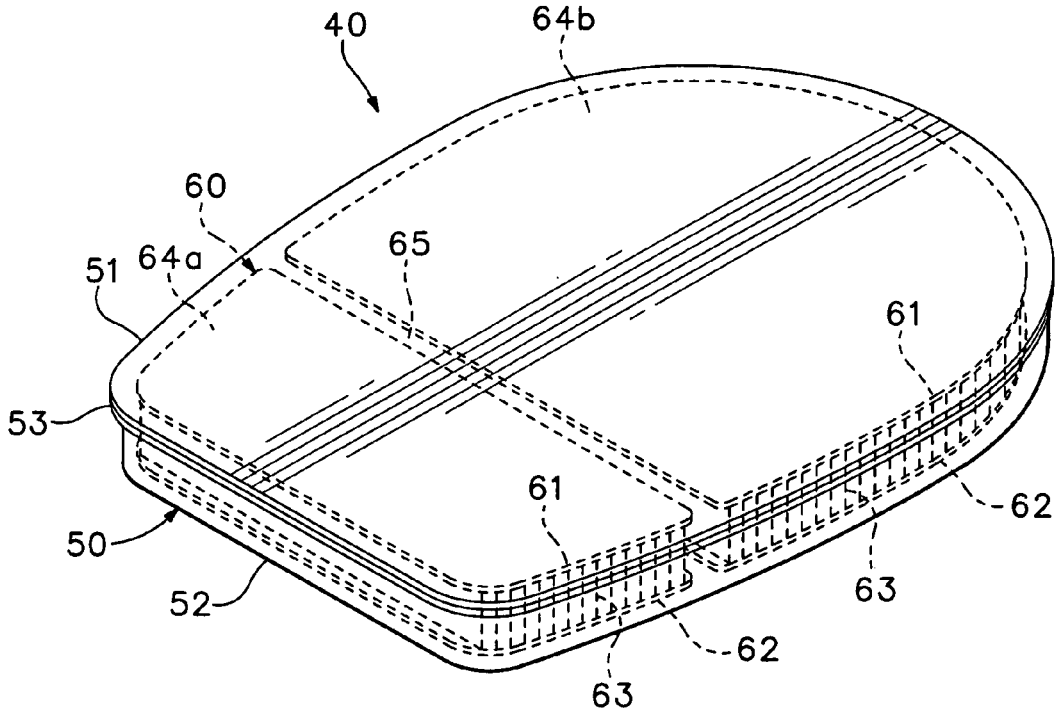
FIG. 2 is a perspective view of the first bladder.

An article of footwear 10 is depicted in FIG. 1 and includes an upper 20 and a sole structure 30. Upper 20 has a substantially conventional configuration and includes a plurality elements, such as textiles, foam, and leather materials, that are stitched or adhesively bonded together to form an interior void for securely and comfortably receiving the foot. Sole structure 30 is positioned below upper 20 and includes two primary elements, a midsole 31 and an outsole 32. Midsole 31 is secured to a lower surface of upper 20, through stitching or adhesive bonding for example, and operates to attenuate forces and absorb energy as sole structure 30 impacts the ground. That is, midsole 31 is structured to provide the foot with cushioning during walking or running, for example. Outsole 32 is secured to a lower surface of midsole 31 and is formed of a durable, wear-resistant material that is suitable for engaging the ground. In addition, sole structure 30 may include an insole (not depicted), which is a thin cushioning member, located within the void and adjacent to the plantar surface of the foot to enhance the comfort of footwear 10.

Midsole 31 is primarily formed of a polymer foam material, such as polyurethane or ethylvinylacetate, that encapsulates a fluid-filled bladder 40. As depicted in FIG. 1, bladder 40 is positioned in a heel region of midsole 31, but may be positioned in any region of midsole 31 to obtain a desired degree of cushioning response. Furthermore, midsole 31 may encapsulate multiple fluid-filled bladders having the general configuration of bladder 40. Bladder 40 may be only partially encapsulated within midsole 31 or entirely encapsulated within midsole 31. For example, portions of bladder 40 may protrude outward from a side surface of midsole 31, or an upper surface of bladder 40 may coincide with an upper surface of midsole 31. Alternately, midsole 31 may extend over and entirely around bladder 40. Accordingly, the position of bladder 40 with respect to footwear 10 may vary significantly within the scope of the invention.

The primary elements of bladder 40, as depicted in FIGS. 2–4B, are an outer barrier 50 and a tensile member 60. Barrier 50 may be formed of a polymer material and includes a first barrier layer 51 and a second barrier layer 52 that are substantially impermeable to a pressurized fluid contained by bladder 40. First barrier layer 51 and second barrier layer 52 are bonded together around their respective peripheries to form a peripheral bond 53 and cooperatively form a sealed chamber, in which tensile member 60 is positioned. Whereas first barrier layer 51 forms the upper surface of bladder 40, second barrier layer 52 forms both the lower surface and sidewall of bladder 40. This configuration positions peripheral bond 53 adjacent to the upper surface and promotes visibility through the sidewall. Alternately, peripheral bond 53 may be positioned adjacent to the lower surface or at a location that is between the upper surface and the lower surface. Peripheral bond 53 may, therefore, extend through the sidewall such that both first barrier layer 51 and second barrier layer 52 form a portion of the sidewall. Accordingly, the specific configuration of barrier 50 may vary significantly within the scope of the present invention.

Tensile member 60 may be formed as a textile structure that includes a first wall 61, a second wall 62, and a plurality of connecting members 63 anchored to each of first wall 61 and second wall 62. First wall 61 is spaced away from second wall 62, and connecting members 63 extend between first wall 61 and second wall 62 to retain a substantially constant spacing between walls 61 and 62. As discussed in greater detail below, first wall 61 is bonded to first barrier layer 51, and second wall 62 is bonded to second barrier layer 52. In this configuration, the pressurized fluid within the chamber formed by barrier 50 places an outward force upon barrier layers 51 and 52 and tends to move barrier layers 51 and 52 apart. The outward force supplied by the pressurized fluid, however, extends connecting members 63 and places connecting members 63 in tension, which restrains further outward movement of barrier layers 51 and 52. Accordingly, tensile member 60 is bonded to the interior surfaces of bladder 40 and limits the degree to which barrier layers 51 and 52 may move apart upon pressurization of bladder 40.

A variety of techniques may be utilized to bond tensile member 60 to each of first barrier layer 51 and second barrier layer 52. For example, a layer of thermally activated fusing agent may be applied to first wall 61 and second wall 62. The fusing agent may be a sheet of thermoplastic material, such as thermoplastic polyurethane, that is heated and pressed into contact with first wall 61 and second wall 62 prior to placing tensile member 60 between barrier layers 51 and 52. The various elements of bladder 40 are then heated and compressed such that the fusing agent bonds with barrier layers 51 and 52, thereby bonding tensile member 60 to barrier 50. Alternately, a plurality of fusing filaments may be integrated into first wall 61 and second wall 62, as disclosed in U.S. patent application Ser. No. 10/642,262, which was filed with the U.S. Patent and Trademark Office on Aug. 18, 2003. The fusing filaments are formed of a material that will fuse, bond, or otherwise become secured to barrier layers 51 and 52 when the various components of bladder 40 are heated and compressed together. Suitable materials for the fusing filaments include, therefore, thermoplastic polyurethane or any of the materials that are discussed above as being suitable for barrier layers 51 and 52. The fusing filaments may be woven or otherwise mechanically manipulated into walls 61 and 62 during the manufacturing process for tensile element 60, or the fusing filaments may be subsequently incorporated into walls 61 and 62.

Figure 3:
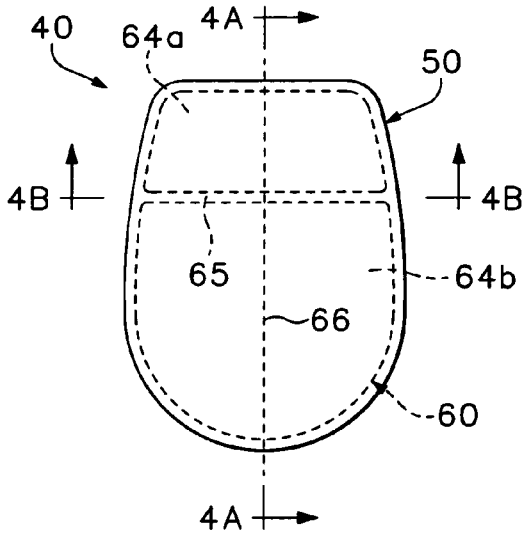
FIG. 3 is a top plan view of the first bladder.

Tensile member 60 includes a pair of discrete sections 64*a* and 64*b* that are separated by a flexion area 65. Referring to FIG. 3, flexion area 65 extends through an interior portion of bladder 40 and forms a separation between sections 64*a* and 64*b*. One advantage of flexion area 65 is that bladder 40 tends to flex or otherwise bend along the line defined by flexion area 65. That is, flexion area 65 forms an area of bladder 40 that is more flexible than other areas of bladder 65. In bending, therefore, the portion of bladder 40 that includes section 64*a* will flex with respect to the portion of bladder 40 that includes section 64*b*. In contrast with the bladders disclosed in U.S. Pat. Nos. 5,993,585 and 6,119,371 to Goodwin et al., therefore, bladder 40 includes a non-continuous tensile member 60 that defines flexion area 65, which extends through an interior portion of bladder 40.

The portions of bladder 40 corresponding with sections 64*a* and 64*b* are effectively formed from seven layers of material: first barrier layer 51, the fusing agent adjacent to first barrier layer 51, first wall 61, connecting members 63, second wall 62, the fusing agent adjacent to second barrier layer 52, and second barrier layer 52. In order for these portions to flex, each of the seven layers of material (with the potential exception of connecting members 63) must either stretch or compress in response to a bending force. In contrast, the portion of bladder 40 corresponding with flexion area 65 is effectively formed from two layers of material: first barrier layer 51 and second barrier layer 52. In order for this portion to flex, only barrier layers 51 and 52 must either stretch or compress in response to the bending force. Accordingly, the portion of bladder 40 corresponding with flexion area 65 will exhibit greater flexibility due to the decreased number of materials present in flexion area 65.

Figure 5:
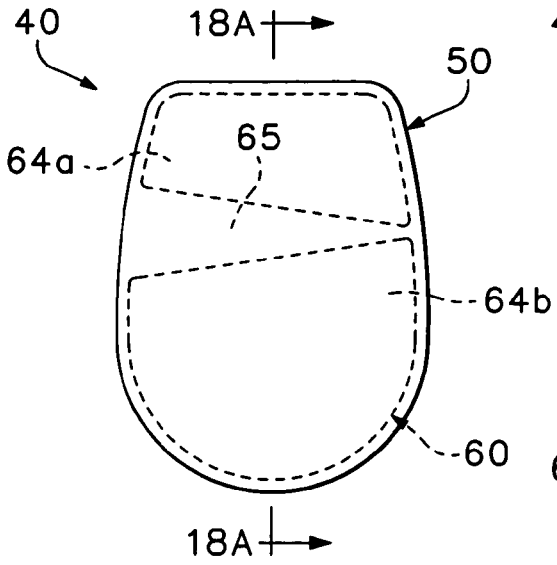
FIG. 5 is a top plan view of a second bladder in accordance with the present invention.
Figure 6:
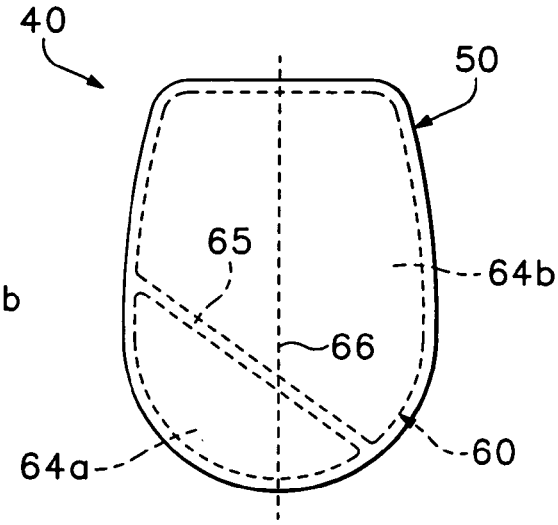
FIG. 6 is a top plan view of a third bladder in accordance with the present invention.

Flexion area 65 is depicted in FIG. 3 as having a constant thickness and extending perpendicular to a longitudinal axis 66. In further embodiments of the invention, the configuration of flexion area 65 may vary significantly. For example, flexion area 65 is depicted as having a varying or tapering thickness in FIG. 5. This particular configuration may be utilized where different degrees of flexibility are desired on opposite sides of bladder 40, or where a spectrum of different degrees of flexibility are desired across the width of bladder 40. Alternately, flexion area 65 may be oriented diagonally with respect to longitudinal axis 66, as depicted in FIG. 6. During running, the rear-lateral portion of footwear 10 generally makes initial contact with the ground, and the rear-lateral portion experiences greater degrees of impact force than other portions of footwear 10. The diagonal orientation of flexion area 65 may be utilized, therefore, to form a flexion line between the portion of bladder 40 that is positioned in the rear-lateral portion and other portions of bladder 40.

Figure 7:
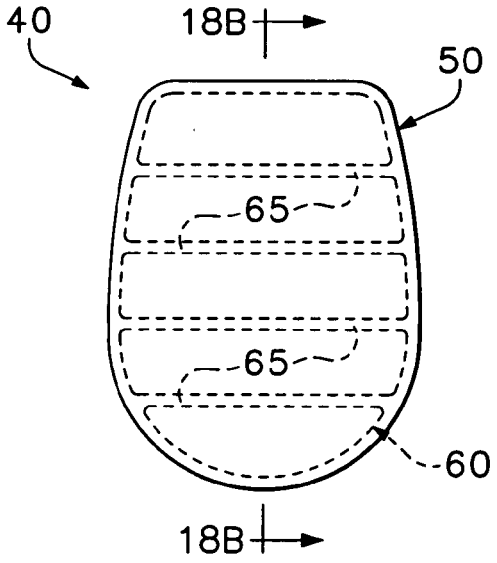
FIG. 7 is a top plan view of a fourth bladder in accordance with the present invention.
Figure 8:
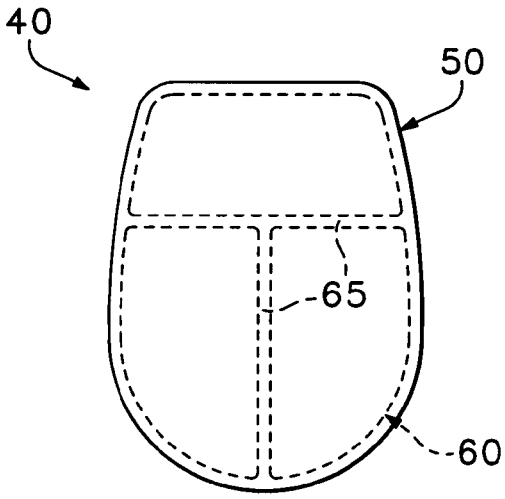
FIG. 8 is a top plan view of a fifth bladder in accordance with the present invention.

Whereas flexion area 65 is depicted in FIG. 3 as being a single space between two sections 64*a* and 64*b* of tensile member 60, flexion area 65 may be a plurality of flexion areas 65 that form spaces between various separate sections of tensile member 60, as depicted in FIG. 7. This configuration provides bladder 40 with a greater number of flexion lines and has the potential to enhance the overall flexibility of bladder 40. In addition, this configuration may exhibit a substantial decrease in the mass of bladder 40 due to the removed portions of tensile member 60 that are associated with the various spaces formed by flexion area 65. The various spaces formed by flexion area 65 may be substantially parallel to each other, but may also have a non-parallel configuration, as depicted in FIG. 8. In this configuration, flexion area 65 may form a T-shaped flexion line and divide tensile member 60 into three discrete sections.

Figure 9:
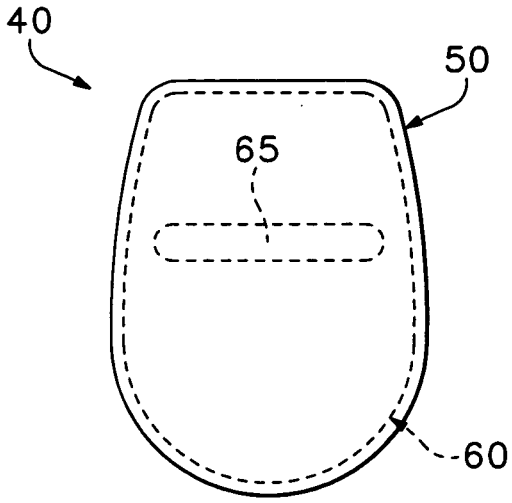
FIG. 9 is a top plan view of a sixth bladder in accordance with the present invention.
Figure 10:
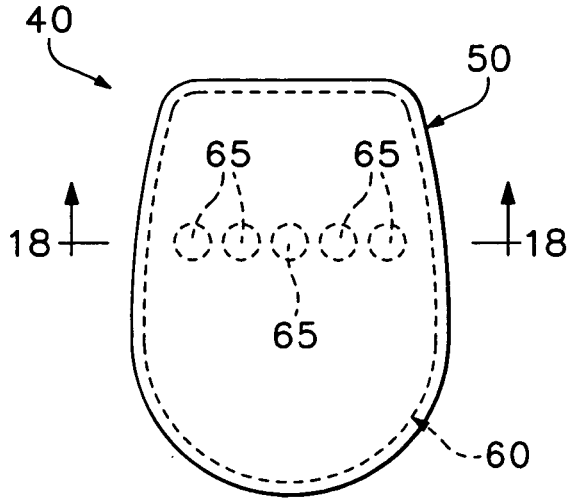
FIG. 10 is a top plan view of a seventh bladder in accordance with the present invention.
Figure 11:
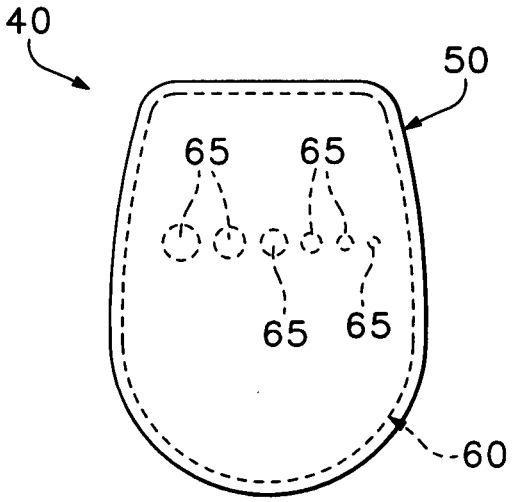
FIG. 11 is a top plan view of a eighth bladder in accordance with the present invention.

Flexion area 65 is discussed above as segregating or otherwise forming discrete sections of tensile member 60. The portion of bladder 40 corresponding with flexion area 65 generally exhibits greater flexibility due to the decreased number of materials present in flexion area 65. The same advantage may be gained, however, by forming flexion area 65 to be an elongate aperture that extends through an interior portion of bladder 40, as depicted in FIG. 9. Flexion area 65 may also exhibit the form of a plurality of apertures that extend across tensile member 60, as depicted in FIG. 10. In this configuration, flexion area 65 forms a flexion line that extends across bladder 40, and the degree of flexibility imparted by flexion area 65 will be generally dependent upon the number and diameter of the apertures formed by flexion area 65. As depicted in FIG. 11, the diameter of the apertures formed by flexion area 65 may also decrease across bladder 40 where different degrees of flexibility are desired across the width of bladder 40.

Figure 12:
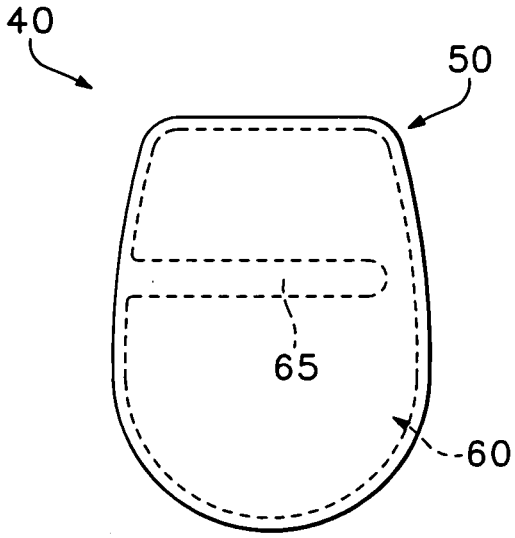
FIG. 12 is a top plan view of a ninth bladder in accordance with the present invention.
Figure 13:
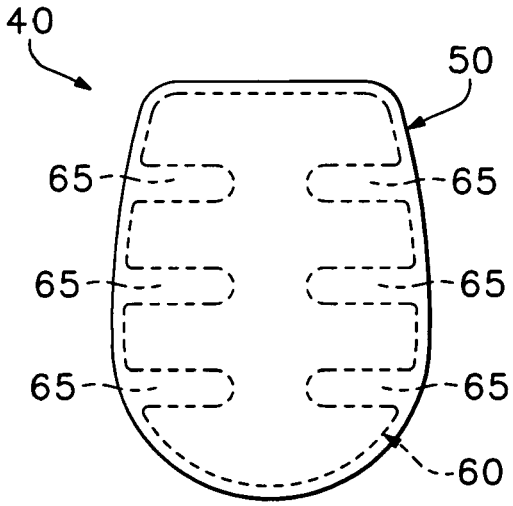
FIG. 13 is a top plan view of a tenth bladder in accordance with the present invention.

In addition to spaces and apertures, flexion area 65 may also be an indentation that extends inward from an edge of tensile member 60, as depicted in FIG. 12. In this configuration, tensile member 60 remains a single element, and the degree of flexibility in bladder 40 may be varied by forming one or more indentations in specific locations. For example, flexion area 65 may be a series of indentations that extend along either side of tensile member 60, as depicted in FIG. 13.

Figure 14:
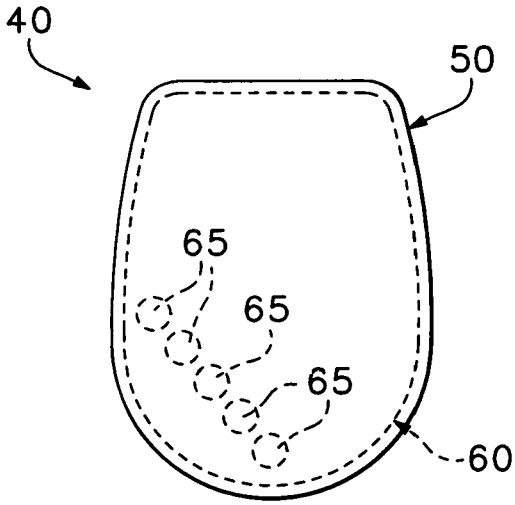
FIG. 14 is a top plan view of an eleventh bladder in accordance with the present invention.
Figure 15:
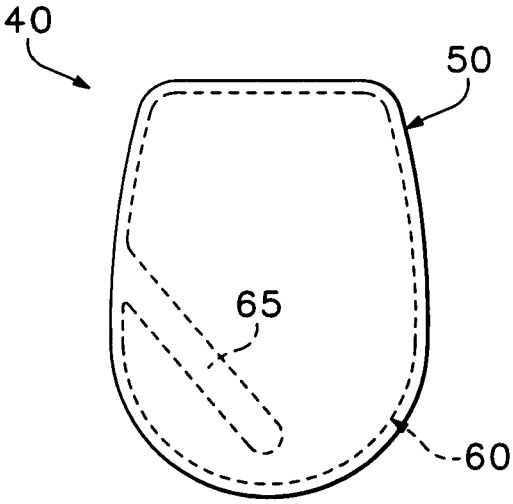
FIG. 15 is a top plan view of a twelfth bladder in accordance with the present invention.

The embodiment of FIG. 6 oriented flexion area 65 diagonally with respect to longitudinal axis 66 to form a flexion line between the portion of bladder 40 that is positioned in the rear-lateral portion and other portions of bladder 40. A similar configuration may be formed through the use of apertures or an indentation, as depicted in FIGS. 14 and 15, respectively. Accordingly, spaces, indentations, and apertures may often be interchanged to impart flexion lines that serve similar purposes. The degree of flexion that is provided by the spaces, indentations, and apertures, however, may depend upon various factors. For example, the specific dimensions selected for the space, indentation, or aperture may be utilized to vary the degree of flexion.

Figure 16:
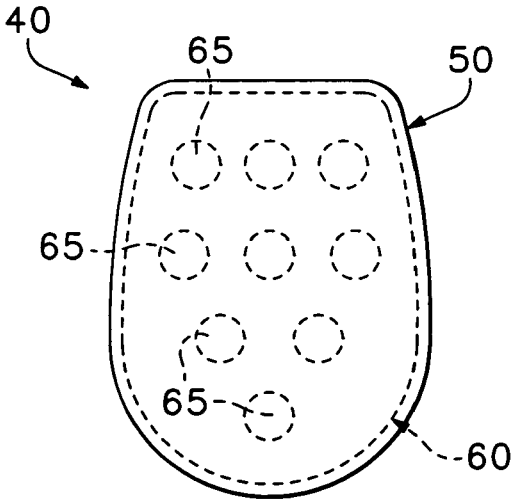
FIG. 16 is a top plan view of a thirteenth bladder in accordance with the present invention.
Figure 17:
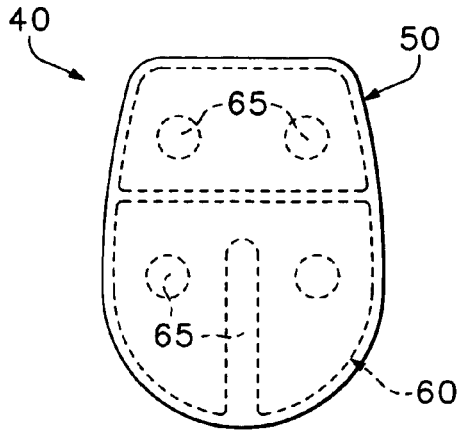
FIG. 17 is a top plan view of a fourteenth bladder in accordance with the present invention.

The various embodiments discussed above provide examples of the manner in which flexion area 65 may be utilized to form a flexion line in bladder 40. Similar concepts may be utilized, however, to increase the overall flexibility of bladder 40. Referring to FIG. 16, flexion area 65 forms a plurality of apertures that are distributed throughout tensile member 60, and this distribution may operate to increase flexibility throughout bladder 40. The various embodiments discussed above also include only one of a space, aperture, or indentation. Combinations of spaces, apertures, and indentations are also contemplated to fall within the scope of the present invention, as depicted in FIG. 17.

Figure 18A:
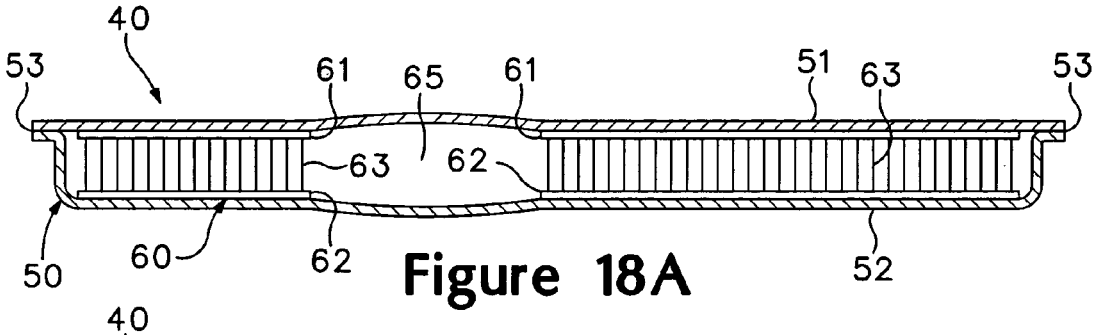
FIG. 18A is a cross-sectional view of the second bladder, as defined by section line 18A—18A in FIG. 5.
Figure 18B:
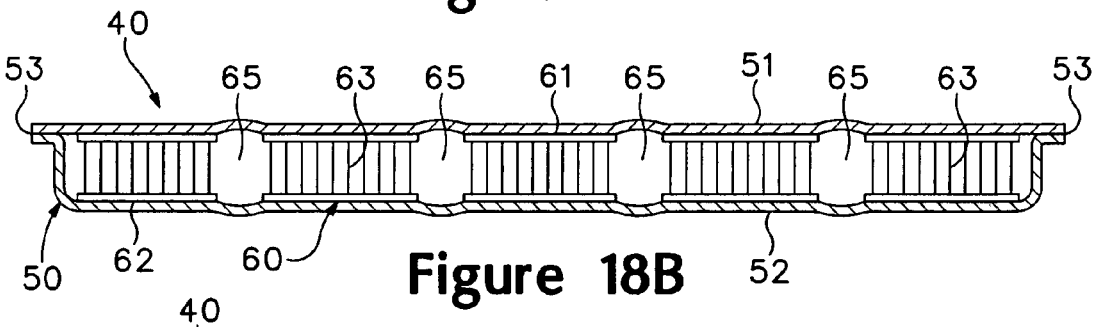
FIG. 18B is a cross-sectional view of the fourth bladder, as defined by section line 18B—18B in FIG. 7.
Figure 18C:
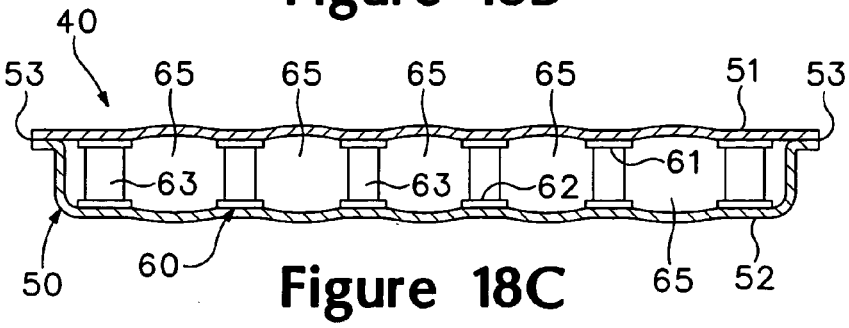
FIG. 18C is a cross-sectional view of the seventh bladder, as defined by section line 18C—18C in FIG. 10.

Many prior art bladders that do not incorporate a tensile member exhibit contoured exterior surfaces due to a plurality of connection points where opposite portions of the polymer barrier are secured to each other. Many prior art tensile bladders, however, do not exhibit significantly contoured exterior surfaces due to the presence of the tensile member. Accordingly, the prior art tensile bladders exhibit relatively planar exterior surfaces. In areas of bladder 40 where tensile member 60 is present, the exterior surfaces are relatively planar, as depicted in the cross-sections of FIGS. 18A–18C. In areas of bladder 40 that correspond with flexion area 65, however, the exterior surface bows or projects outward, also as depicted in the cross-sections of FIGS. 18A–18C. The presence or absence of portions of tensile member 60 may be utilized, therefore, to form the exterior surfaces of bladder 40 with a specific contoured configuration.

The material forming barrier 50 may be a polymer material, such as a thermoplastic elastomer. More specifically, a suitable material for barrier 50 is a film formed of alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Another suitable material for barrier 50 is a flexible microlayer membrane that includes alternating layers of a gas barrier material and an elastomeric material, as disclosed in U.S. Pat. Nos. 6,082,025 and 6,127,026 to Bonk et al., both hereby incorporated by reference. Other suitable thermoplastic elastomer materials or films include polyurethane, polyester, polyester polyurethane, polyether polyurethane, such as cast or extruded ester-based polyurethane film. Additional suitable materials are disclosed in U.S. Pat. Nos. 4,183,156 and 4,219,945 to Rudy, hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos.

6,013,340; 6,203,868; and 6,321,465 to Bonk et al., also hereby incorporated by reference. The fluid contained by bladder 40 may be any of the gasses disclosed in U.S. Pat. No. 4,340,626 to Rudy, hereby incorporated by reference, such as hexafluoroethane and sulfur hexafluoride, for example. In addition, the fluid may include pressurized octafluorapropane, nitrogen, and air. The pressure of the fluid may range from a gauge pressure of zero to forty pounds per square inch, for example.

A plurality of manufacturing methods may be employed for tensile member 60, including a double needle bar Raschel knitting process. Each of first wall 61, second wall 62, and connecting members 63 may be formed of air-bulked or otherwise texturized yarn, such as false twist texturized yarn having a combination of Nylon 6,6 and Nylon 6, for example. Although the thickness of tensile member 60, which is measured when connecting members 63 are in a tensile state between first wall 61 and second wall 62, may vary significantly within the scope of the present invention, a thickness that is suitable for footwear applications may range from 8 to 15 millimeters.

Connecting members 63 may have a denier per filament of approximately 1 to 20, with one suitable range being between 2 and 5. The individual tensile filaments that comprise connecting members 63 may exhibit a tensile strength of approximately 2 to 10 grams per denier and the number of tensile filaments per yarn may range from approximately 1 to 100, with one suitable range being between 40 and 60. In general, there are approximately 1 to 8 yarns per tuft or strand and tensile member 60 may be knitted with approximately 200 to 1000 tufts or strands per square inch of fabric, with one suitable range being between 400 and 500 strands per square inch. The bulk density of the fabric is, therefore, in the range of about 20,000 to 300,000 fibers per square inch-denier.

Figure 4A:
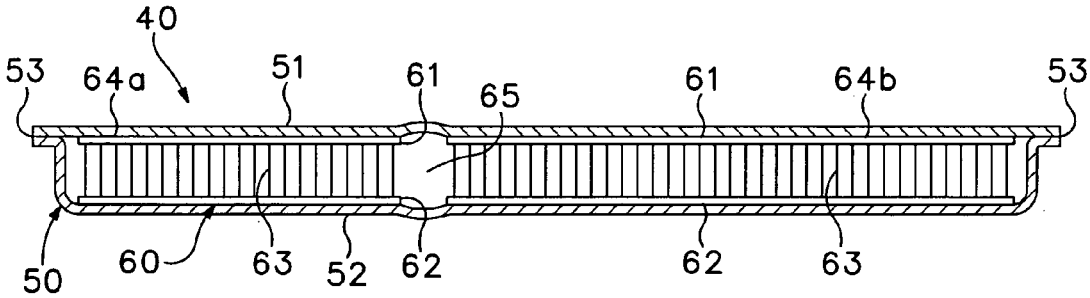
FIG. 4A is a first cross-sectional view of the first bladder, as defined by section line 4A—4A in FIG. 3.
Figure 4B:
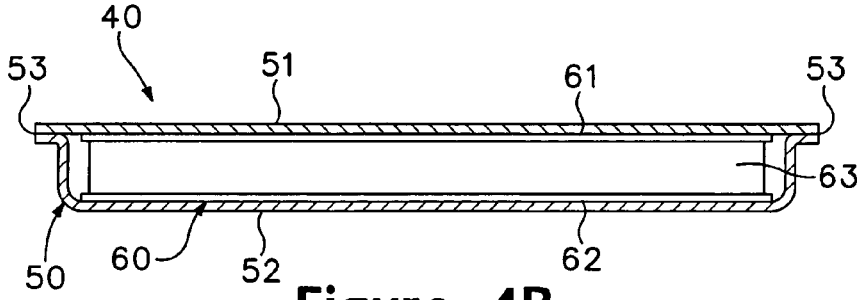
FIG. 4B is a second cross-sectional view of the first bladder, as defined by section line 4B—4B in FIG. 3.

Connecting members 63 may be arranged in rows that are separated by gaps. The use of gaps provides tensile member 60 with increased compressibility in comparison to tensile members formed of double-walled fabrics that utilize continuous connecting yarns. The gaps may be formed during the double needle bar Raschel knitting process by omitting connecting yarns on certain predetermined needles in the warp direction. Knitting with three needles in and three needles out produces a suitable fabric with rows of connecting members 63 being separated by gaps. Other knitting patterns of needles in and needles out may also be used, such as two in and two out, four in and two out, two in and four out, or any combination thereof. Also, the gaps may be formed in both a longitudinal and transverse direction by omitting needles in the warp direction or selectively knitting or not knitting on consecutive courses. Tensile member 60, as depicted in FIG. 4A, has relatively large gaps between connecting members 63. Alternatively, the gaps may be smaller or connecting members 63 may extend throughout tensile member 60.

A variety of manufacturing methods may be employed to produce bladder 40, including a thermoforming process as disclosed in U.S. patent application Ser. No. 09/995,003, which was filed with the U.S. Patent and Trademark Office on Nov. 26, 2001. During a preliminary stage of the manufacturing method, tensile member 60 is temporarily attached to one of barrier layer 51, and barrier layer 52 is placed over tensile member 60, thereby locating tensile member 60 between barrier layers 51 and 52. An inflation needle and a spacer are also placed between barrier layers 51 and 52 and the various components are secured in place using clamps on a shuttle frame. The components are then heated in an oven for a predetermined period of time. The oven softens the thermoplastic sheets of barrier layers 51 and 52 such that bonding may occur in future steps.

Following heating, the components are positioned in a mold that includes two opposing portions. The mold compresses the components, thereby bonding tensile member 60 to barrier layers 51 and 52 (i.e., bonding the fusing agent to barrier layers 51 and 52), and also bonding barrier layers 51 and 52 to each other through the process of time-dependent, thermal contact welding. A partial vacuum may be applied to the outer surfaces of barrier layers 51 and 52 and a gas may be injected into the area around tensile member 60 to facilitate drawing barrier layers 51 and 52 against the surfaces of the mold. Once bonding is complete, the mold is opened and the components are removed and permitted to cool. As a final stage, bladder 40 is pressurized with the fluid through an inflation conduit and the inflation conduit is sealed.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A fluid-filled bladder for an article of footwear, the bladder comprising:

a sealed outer barrier that is substantially impermeable to the fluid contained by the bladder; and a tensile member located within the barrier and bonded to opposite sides of the barrier, the tensile member defining a flexion area that promotes flexing of a first portion of the bladder with respect to a second portion of the bladder, the flexion area being a space between two separate sections of the tensile member, each of the two separate sections being located within one of the first portion or the second portion of the bladder, at least a portion of the opposite sides of the barrier being unbonded to each other in the space to permit the fluid to flow between the first portion and the second portion of the bladder.

2. The fluid-filled bladder recited in claim 1, wherein the space is an area where the tensile member is substantially absent from the bladder.

3. The fluid-filled bladder recited in claim 2, wherein the space is oriented diagonally with respect to a longitudinal axis of the bladder.

4. The fluid-filled bladder recited in claim 2, wherein the space is oriented perpendicular to a longitudinal axis of the bladder.

5. The fluid-filled bladder recited in claim 2, wherein a width of the space is constant between the two separate sections of tensile member.

6. The fluid-filled bladder recited in claim 2, wherein a width of the space varies between the two separate sections of the tensile member.

7. The fluid-filled bladder recited in claim 1, wherein the flexion area is a plurality of spaces between separate sections of the tensile member.

8. The fluid-filled bladder recited in claim 7, wherein the plurality of spaces are substantially parallel to each other.

9. The fluid-filled bladder recited in claim 1, wherein the flexion area is at least one aperture extending through the tensile member.

10. The fluid-filled bladder recited in claim 9, wherein the at least one aperture is a series of apertures.

11. The fluid-filled bladder recited in claim 10, wherein at least two of the apertures in the series of apertures have different areas.

12. The fluid-filled bladder recited in claim 1, wherein the flexion area is at least one indentation extending inward from an edge of to tensile member.

13. The fluid-filled bladder recited in claim 12, wherein the at least one indentation is a series of indentations.

14. The fluid-filled bladder recited in claim 12, wherein the at least one indentation is a series of indentations extending along opposite sides of the tensile member.

15. The fluid-filled bladder recited in claim 1, wherein the tensile member includes a pair of spaced wall structures joined by a plurality of connecting members.

16. The fluid-filled bladder recited in claim 15, wherein the tensile member is formed of a textile material.

17. The fluid-filled bladder recited in claim 15, wherein the flexion area is a portion of the bladder where the tensile member is absent.

18. The fluid-filled bladder of claim 1, wherein the barrier is formed of a first layer and a second layer of polymer material that are bonded together around a periphery of the tensile member.

19. The fluid-filled bladder recited in claim 1, wherein the bladder is incorporated into a sole structure of the footwear.

20. An article of footwear having a upper for receiving a foot of a wearer and a sole structure secured to the upper, the sole structure comprising:

a midsole formed of a polymer foam material; and a bladder at least partially encapsulated by the polymer foam material, the bladder including:

an outer barrier that is substantially impermeable to a pressurized fluid contained by the bladder, and a tensile member located within the barrier, the tensile member including a pair of spaced wall structures joined by a plurality of connecting members, the wall structures being bonded to opposite sides of the barrier such that the connecting members are placed in tension to restrain outward movement of the barrier, the tensile member defining at least one flexion area where the wall structures and connecting members are absent to promote flexing of the fluid-filled bladder.

21. The article of footwear recited in claim 20, wherein to tensile member includes two separate sections that are each located in one of a first portion and a second portion of the bladder and the flexion area is a space between the two separate sections that permits the first portion to flex relative to the second portion of the bladder.

22. The article of footwear recited in claim 21, wherein the space is oriented diagonally with respect to a longitudinal axis of the bladder.

23. The article of footwear recited in claim 22, wherein the first portion is positioned in a rear-lateral region of the footwear.

24. The article of footwear recited in claim 21, wherein the space is oriented perpendicular to a longitudinal axis of the bladder.

25. The article of footwear recited in claim 20, wherein the flexion area is a plurality of spaces between separate sections of the tensile member.

26. The article of footwear recited in claim 20, wherein the flexion area is at least one aperture extending through the tensile member.

27. The article of footwear recited in claim 26, wherein the at least one aperture is a series of apertures.

28. The article of footwear recited in claim 20, wherein the flexion area is at least one indentation extending inward from an edge of the tensile member.

29. The article of footwear recited in claim 28, wherein the at least one indentation is a series of indentations extending along opposite sides of the tensile member.

30. A fluid-filled bladder for an article of footwear, the bladder comprising:

a sealed outer barrier that forms a first surface, an opposite second surface, and a sidewall extending between the first surface and the second surface, the barrier being substantially impermeable to the fluid contained by the bladder; and a tensile member enclosed within the barrier and bonded to each of the first surface and the second surface, the tensile member being present in a first area of the bladder and absent in a second area of the bladder, the second area of the bladder being spaced inward from the sidewall, wherein at least one of the first surface and the second surface are substantially planar in the first area, and the at least one of the first surface and the second surface project outward in the second area.

31. The fluid-filled bladder recited in claim 30, wherein the tensile member includes a pair of spaced wall structures joined by a plurality of connecting members.

32. The fluid-filled bladder recited in claim 31, wherein the wall structures are bonded to the first surface and the second surface in the first area.

33. The fluid-filled bladder recited in claim 30, wherein the second area exhibits greater flexibility than the first area to promote flexing of the bladder.

34. The fluid-filled bladder recited in claim 30, wherein the second area includes a space between two separate sections of the tensile member.

35. The fluid-filled bladder recited in claim 34, wherein the space forms a flexion line between two portions of the bladder.

36. The fluid-filled bladder recited in claim 34, wherein the space is oriented diagonally with respect to a longitudinal axis of the bladder.

37. The fluid-filled bladder recited in claim 36, wherein the bladder is incorporated into the footwear such that one of the two separate sections of the tensile member is located in a rear-lateral portion of the footwear.

38. The fluid-filled bladder recited in claim 36, wherein the second area includes at least one aperture extending trough the tensile member.

39. The fluid-filled bladder recited in claim 30, wherein the second area is at least one indentation extending inward from an edge of the tensile member.

40. The fluid-filled bladder recited in claim 30, wherein the bladder is incorporated into a sole structure of the footwear.

41. A fluid-tilled bladder for an article of footwear, the bladder comprising:

a sealed outer barrier having a first surface and an opposite second surface, the barrier being substantially impermeable to the fluid contained by the bladder; and a tensile member located within the barrier and bonded to each of the first surface and the second surface, the tensile member having a first section and a separate second section that are spaced from each other to define a flexion area, each of the first section end the second section including a pair of spaced wall structures joined by a plurality of connecting members, the first surface being unbonded to the second surface in at least a portion of the flexion area, and at least one of the first surface and the second surface projecting outward in the flexion area.

42. The fluid-filled bladder recited in claim 41, wherein the tensile member is substantially absent from the bladder in the flexion area.

43. The fluid-filled bladder recited in claim 41, wherein the tensile member is a textile material.

44. The fluid-filed bladder of claim 41, wherein the barrier is formed of a first layer and a second layer of polymer material that are bonded together around a periphery of the tensile member.

45. The fluid-filled bladder recited in claim 41, wherein the wall structures are bonded to the first surface and die second surface.

46. The fluid-filled bladder recited in claim 41, wherein the bladder is incorporated into a sole structure of the footwear.

* * * * *